US005529515A

United States Patent [19]

Ohtaka et al.

[11] Patent Number: 5,529,515

[45] Date of Patent: Jun. 25, 1996

[54] CONNECTOR EQUIPPED WITH FRONT MEMBER

[75] Inventors: Kazuto Ohtaka; Hitoshi Saito, both of Shizuoka, Japan

[73] Assignee: Yazaki Corporation, Tokyo, Japan

[21] Appl. No.: 280,509

[22] Filed: Jul. 26, 1994

[51] Int. Cl.[6] ..... H01R 13/40

[52] U.S. Cl. ..... 439/595; 29/733

[58] Field of Search ..... 439/595; 29/837, 29/733

[56] References Cited

U.S. PATENT DOCUMENTS

| | | | |
|---|---|---|---|
| 4,784,617 | 11/1988 | Oda | 439/595 |
| 4,820,198 | 10/1987 | Lulko et al. | 439/595 |
| 5,057,040 | 10/1991 | Kodama et al. | 439/595 |
| 5,108,310 | 4/1992 | Sawada et al. | 439/595 |
| 5,108,318 | 4/1992 | Sakurai et al. | 439/744 |
| 5,187,862 | 2/1993 | Ohsumi | 29/764 |
| 5,256,083 | 10/1993 | Yamamoto | 439/595 |
| 5,322,457 | 6/1994 | Tsuji et al. | 439/595 |
| 5,397,249 | 3/1995 | Endo et al. | 439/595 |

FOREIGN PATENT DOCUMENTS

| | | |
|---|---|---|
| 0361771A2 | 9/1989 | European Pat. Off. . |
| 0492589A2 | 7/1992 | European Pat. Off. . |
| 3-285280 | 12/1991 | Japan . |
| 5-30031 | 5/1993 | Japan . |

*Primary Examiner*—David L. Pirlot
*Assistant Examiner*—Barry Matthew L. Standig
*Attorney, Agent, or Firm*—Nikaido, Marmelstein, Murray & Oram

[57] ABSTRACT

A connector is equipped with a front member in which a plurality of terminal containers for accommodating female terminal metal fittings are arranged in parallel in a transverse direction and resilient locking pieces of the terminal containers exposed forward are arranged in parallel in the transverse direction. The front member is composed of two through-hole portions. Each through-hole portion has jig insertion recesses continuously formed, wherein in the recess of jig insertion, respective substantial halves of two adjacent terminal containers appear, and the tapered guide surface formed on both edges of the recess of jig insertion partially overlap the periphery of the opening portion of each of the two terminal containers on the side of the resilient locking piece. Thus, a partner male terminal metal fittings can be smoothly guided into each terminal container through the front member provided at the connector housing.

5 Claims, 7 Drawing Sheets

CONNECTOR EQUIPPED WITH FRONT MEMBER

BACKGROUND OF THE INVENTION

1. Field of the Invention

The present invention relates to a multi-pole connector used for connection for a wiring harness for motor vehicles.

2. Description of the Prior Art

With an increase of the number of wirings due to an increase in the number of electric components, there is a tendency that the connector used for connection of the wirings has a multi-pole and large-scale. But there is a limit to large-scaling considering the limited space within a motor vehicle.

In order to solve such a problem, it was proposed to provide a multi-pole connector having a more narrow pitch. Such a connector, however, has the following problem which will be described below. As shown in FIGS. 10A and 10B, in the periphery of the front opening c of a housing b for accommodating female terminal metal fittings a, a tapered guide surface d which permits smooth insertion of a partner male metal fittings (not shown) is provided. In the case of the connector equipped with a narrowed pitch, however, there is a very small difference between the width W1 of a male terminal insertion opening c and the width W2 of a resilient locking piece e for locking the female terminal metal fittings a (The resilient locking piece e having the narrowed width e to provide a significant difference will decrease a terminal holding force). Therefore, considering the "drawing" in molding, the tapered guide surface d cannot be entirely provided at the upper portion of the opening c where the resilient locking piece e is located.

In order to obviate such a difficulty, it was proposed to shift upwards the resilient locking piece so that the tapered guide surface can be provided in the entire periphery of the opening c. In this case, however, the height of the female terminal metal fittings a' will increase from H1 to H2, thus increasing the outer diameter of a housing b' disadvantageously.

SUMMARY OF THE INVENTION

An object of the present invention is to provide a connector equipped with a front member which can guide a male terminal metal fitting into an opening therefor through the front member provided in a connector housing.

In order to attain the above object, in accordance with the present invention, there is provided a connector equipped with a front member in which a plurality of terminal containers for accommodating female terminal metal fittings are arranged in parallel in a transverse direction and resilient locking pieces of the terminal containers exposed forward are arranged in parallel in the transverse direction, comprising a front member composed of two through-hole portions, each said through-hole portion having jig insertion recesses continuously formed, wherein in said recess of jig insertion, respective substantial halves of two adjacent terminal containers appear, and the tapered guide surface formed on both edges of the said recess of jig insertion partially overlap the periphery of the opening portion of each of said two terminal containers on the side of said resilient locking piece.

In operation, in fitting with a partner connector, partner female terminal metal fittings can be smoothly guided into the opening portion of a terminal container through tapered guide surfaces. A jig can be inserted from a recess therefor to drive a resilient locking piece.

In accordance with the present invention, the front member can be provided with jig insertion recesses and also be provided with tapered guide surfaces for smoothly inserting the partner male terminal metal fittings as well as jig insertion recesses. The metal fittings can be drawn through the jig insertion recess without detaching the front member. Further, a wide recess for insertion of the terminal drawing jig can be given so that the jig with a sufficient strength can be obtained.

The function of the terminal fixing member, when it is used as the front member, can be greatly increased.

The above and other objects and features of the present invention will be more apparent from the following description taken in conjunction with the accompanying drawings.

DESCRIPTION OF THE PREFERRED EMBODIMENTS

Figure 1:
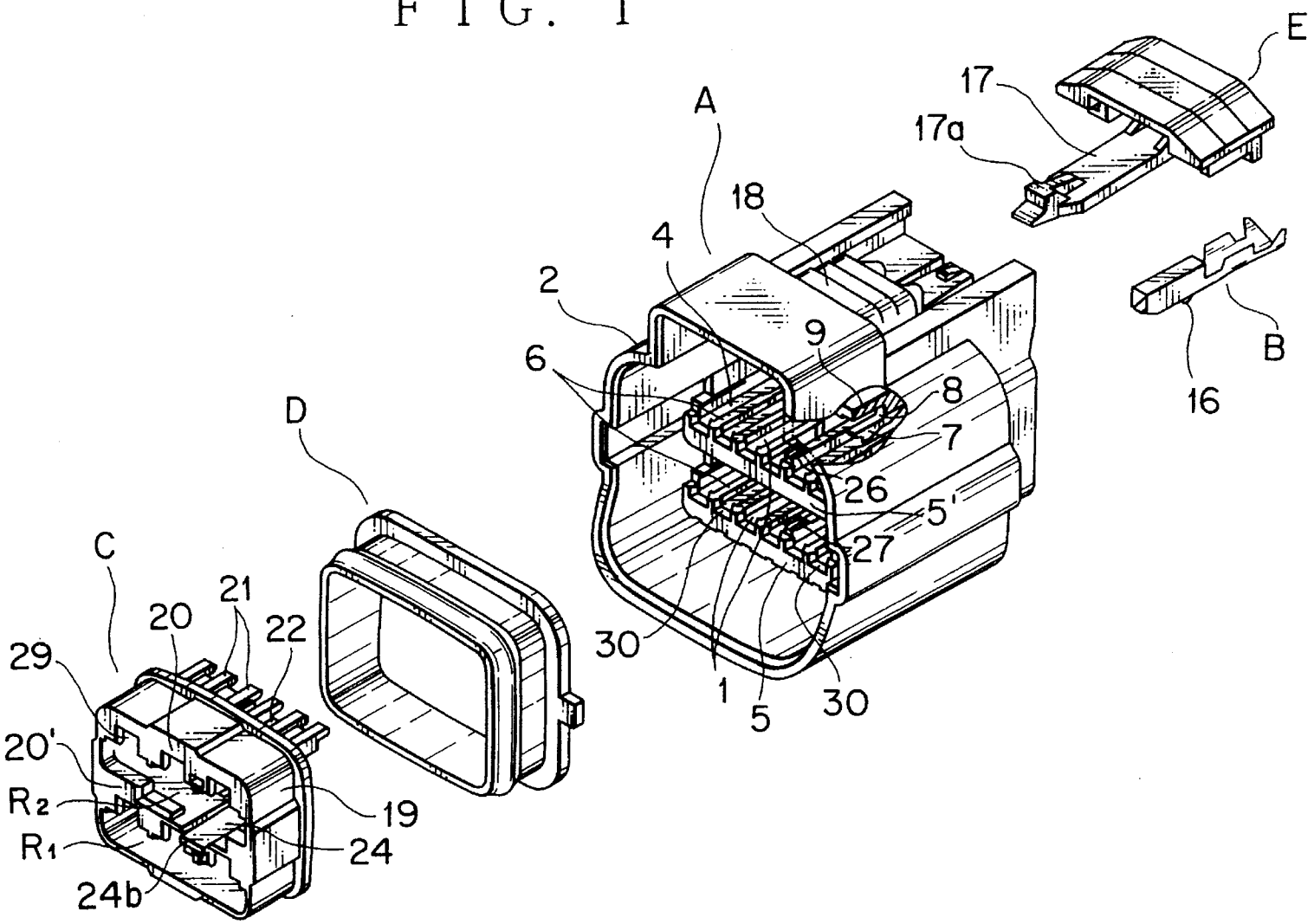
FIG. 1 is a exploded perspective view of one embodiment of the present invention.

In FIG. 1, element A denotes a connector housing; element B denotes a female terminal metal fittings; element C denotes a front member for terminal fixing; element D denotes a ring-shaped water-proofing packing; and E denotes a slider for locking recognition.

Now referring to FIGS. 1 to 3, an explanation will be given of the connector housing A and the components relative thereto. In the connector housing A, six terminal containers 1 arranged in parallel are placed on two (upper and lower) stages within a cover 2. The upper wall 3 of each terminal container 1 is recessed to provide an opened portion 4. The respective containers 1 are connected through their side walls 6 on each of a pair of continuous bottom walls 5 and 5'.

A cantilever resilient locking piece 7 overlooking the terminal container 1 is provided at the end of the upper wall 3 of the terminal container 1. A pair of fixed walls 9 and 9' are provided apart from the resilient locking piece 7 by a space where the locking piece 7 can move. The upper fixed wall 9 is connected to a lower bottom wall 5 in a circular shape, and a water-proof packing D is fit in the outer periphery of the circular shape. In each terminal container 1, a guide slit 10 or a guide groove 10' extending in their longitudinal direction are formed in the bottom wall 5 or 5'.

Figure 2:
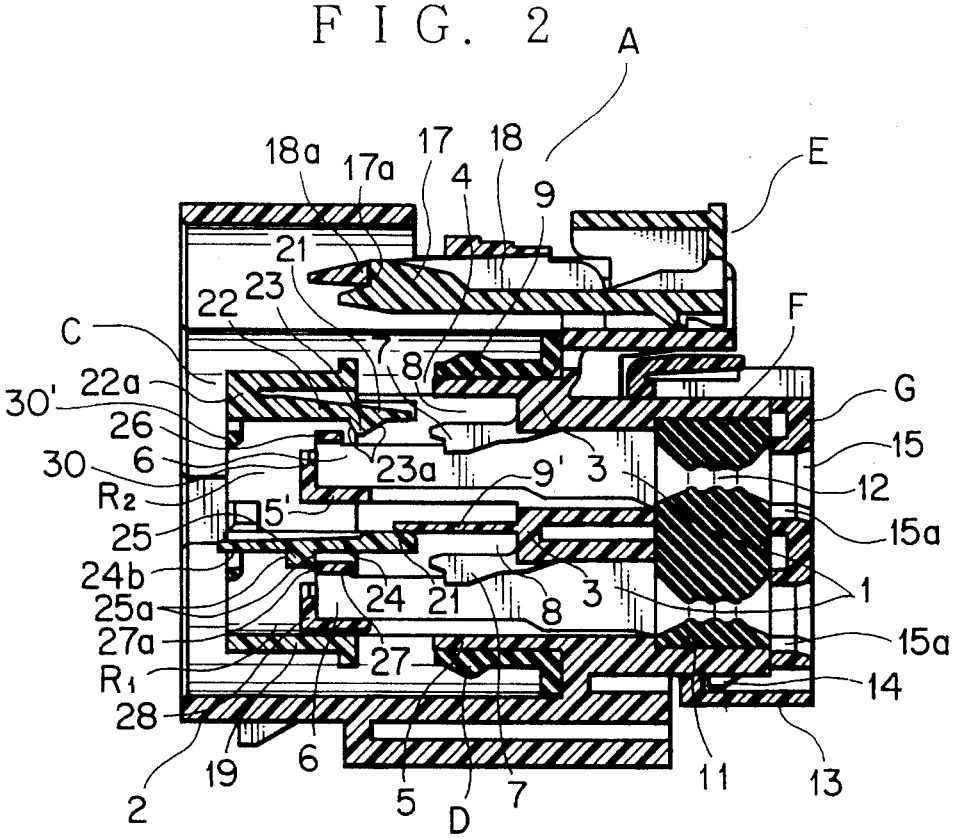
FIG. 2 is a sectional view in a state where a front member for terminal fixing is provisionally locked with a connector housing.

At the rear part of the connector housing A, a fitting chamber 11 for a Water proof stopper F is formed (see FIG. 2). The water proof stopper F made of a resilient member such as rubber has a circular sealing through-hole 12 corresponding to each terminal container 1. The rear end portion of the connector housing A is covered with a water-proof stopper holding cover G. A resilient arm 13 formed in the peripheral wall of the cover G is fixed in engagement with a locking protrusion 14 on the peripheral surface of the connector housing A to prevent the water-proof stopper F from falling away. The water-proof stopper G has a square through-hole 15 corresponding to the sealing through-hole 12 for the water-proof holding cover G. On the side of the guide slit 10 or guide groove 10' in the through-hole 15, a concave portion 15*a* for defining the insertion posture of the terminal metal fittings B is formed. The bottom wall of a female terminal metal fitting B has a convex portion 16 for defining the insertion posture (FIG. 3).

The slider E for locking detection has a locking detection arm 17. The stopper 17*a* at the free end of the locking detection arm 17 is engaged with the locking portion 18*a* at the free end of the locking arm 18 (FIG. 2). When the connector housing A is completely coupled with a partner connector housing so that the locking portion 18 of the locking arm 18*a* is engaged with the locking portion (not shown) of the partner connector housing, the locking detection arm 17 escapes from the restriction by the locking arm 18. Thus, the slider E for locking detection can advance so that the complete fitting or coupling can be recognized (JP-A (Laid-Open) No. Hei 3-285280 (1991)).

As seen from FIG. 1, the front member C for terminal fixing has a cylindrical peripheral wall 19 which is provided with supporting plate members 20 and 20' at its upper and intermediate portions. At the supporting plate portions 20 and 20', restriction pieces 21 which correspond to the space 8 of the above resilient locking piece 7 are provided in parallel in a horizontal direction. The entire front member C is provided slidably in the longitudinal direction of the group of the terminal containers 1, 1 . . . in a state where the through-hole portions R1 and R2 sectioned by an intermediate supporting plate portion 20' and extending in the longitudinal direction are coupled with the group of terminal containers 1, 1 . . . on the corresponding bottom walls 5 and 5'.

Figure 6:
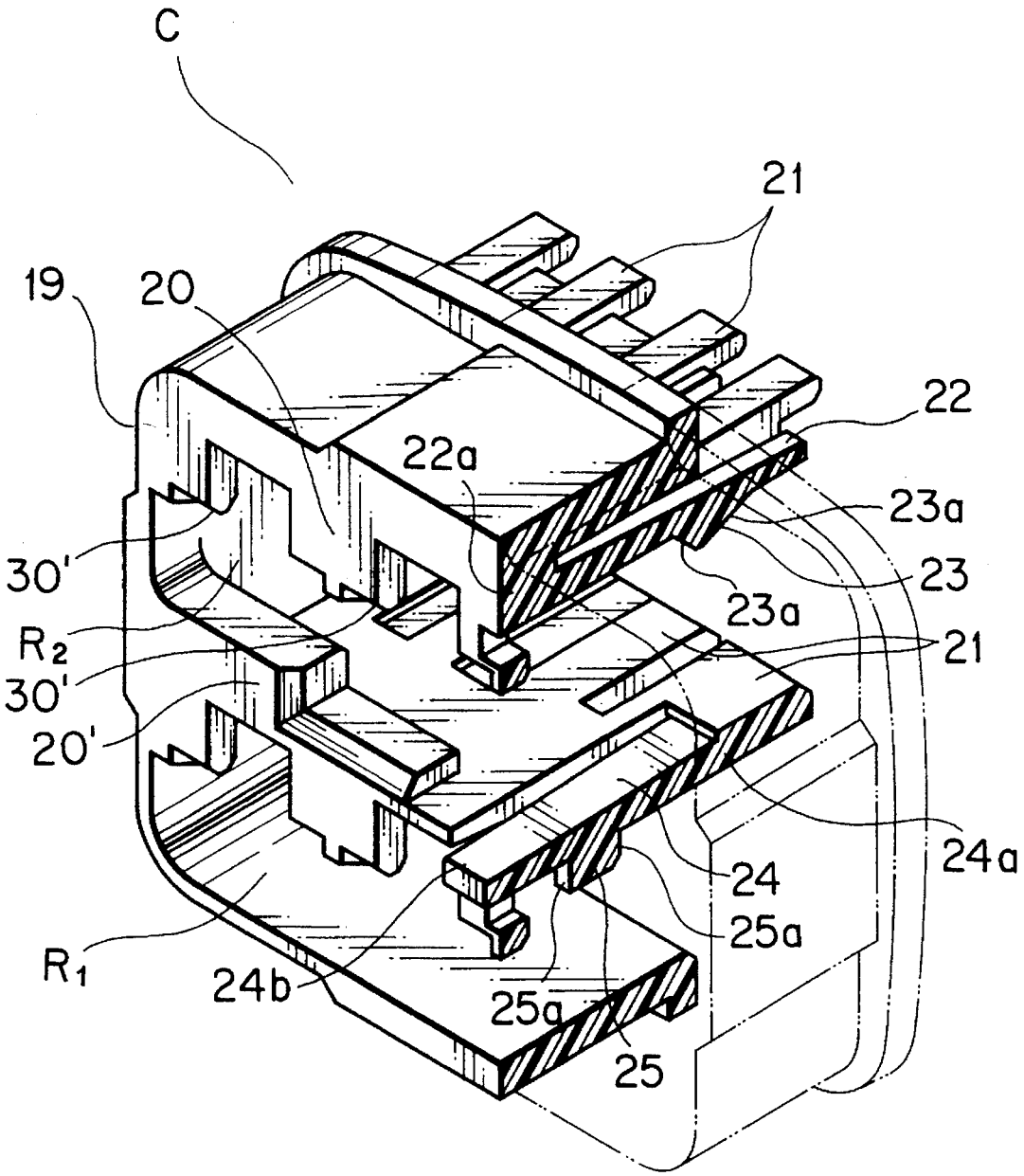
FIG. 6 is a partially exploded perspective view of the front member for terminal fixing viewed from the inclined front.
Figure 7:
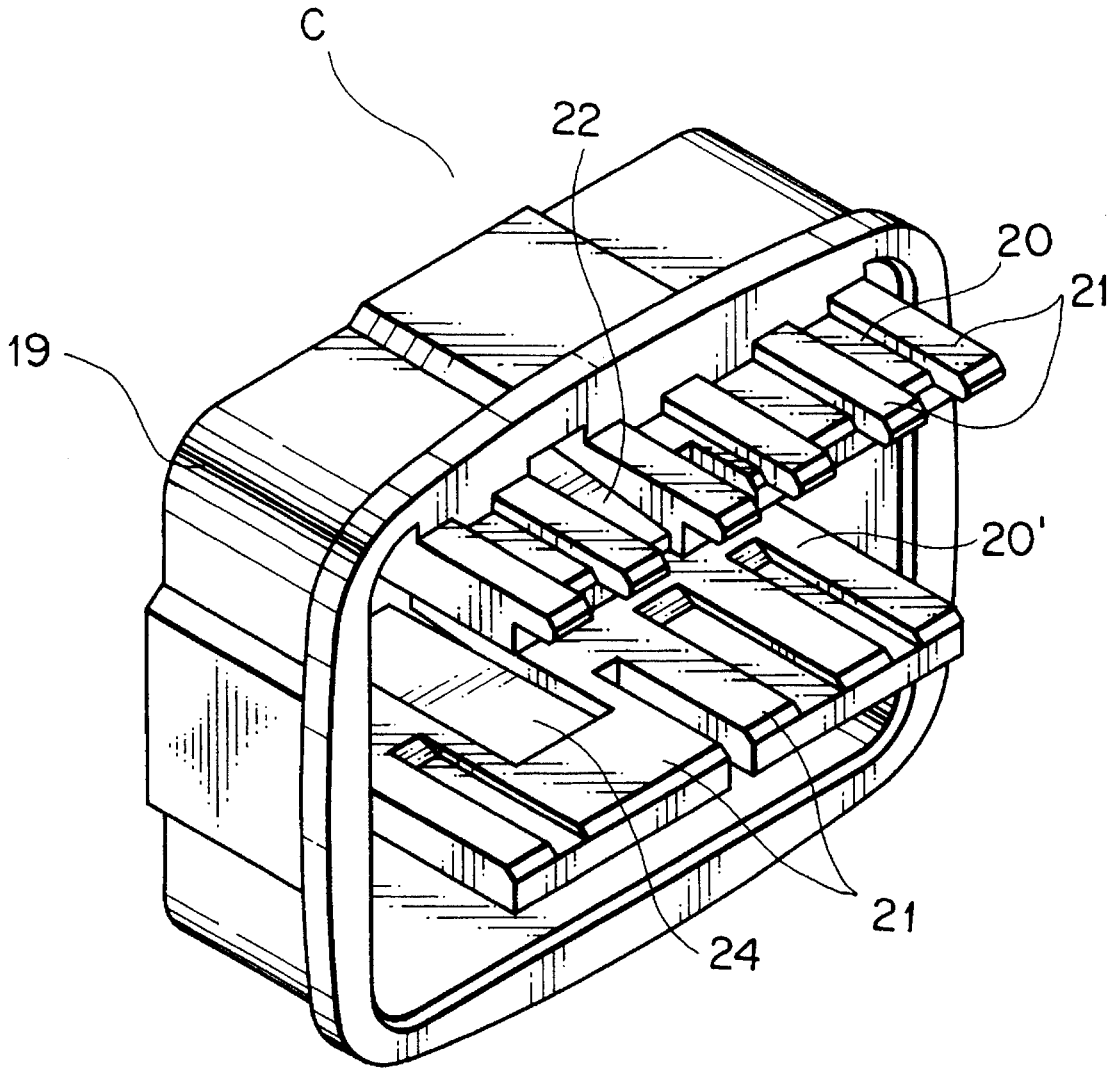
FIG. 7 is a partially exploded perspective view of the front member for terminal fixing viewed from the inclined rear.

As seen from FIGS. 6 and 7, in the front member C, the upper supporting plate portion 20 is provided with a provisional locking resilient arm 22 the free end of which extends from a stem 22*a* towards the connector housing A. The provisional locking resilient arm 22 is provided with a provisional locking protrusion 23 with tapered engagement surfaces 23*a* and 23*a* on both front and rear positions in the shifting direction.

As seen from FIG. 6, the intermediate supporting plate portion 20' is provided with a real locking resilient arm 24 the free end of which extends from a stem 24*a* on the side of the connector housing A outwardly. The intermediate portion of the real locking resilient arm 24 is provided with a real locking protrusion 25 having vertical engagement surfaces 25*a* and 25*a* on both front and rear positions in the shifting direction. The free end portion is provided with a handling portion 24.

The side wall 6 which sections the terminal containers of the connector housing A is provided with a provisional locking portion 26 and real locking portion 27 which are protrusive.

FIG. 2 shows the state where the front member C is provisionally locked with the connector housing A. The tapered engagement surface 23*a* of the provisional locking protrusion 23 in the provisional locking resilient arm 22 is engaged with the inside of the provisional locking 26. The vertical engagement surface 25*a* of the real locking protrusion 25 in the real locking resilient arm 24 is also engaged with the outer vertical engagement surface of the real locking portion 27. Therefore, the front member C will not move towards the connector housing C owing to unexpected external force.

Figure 3:
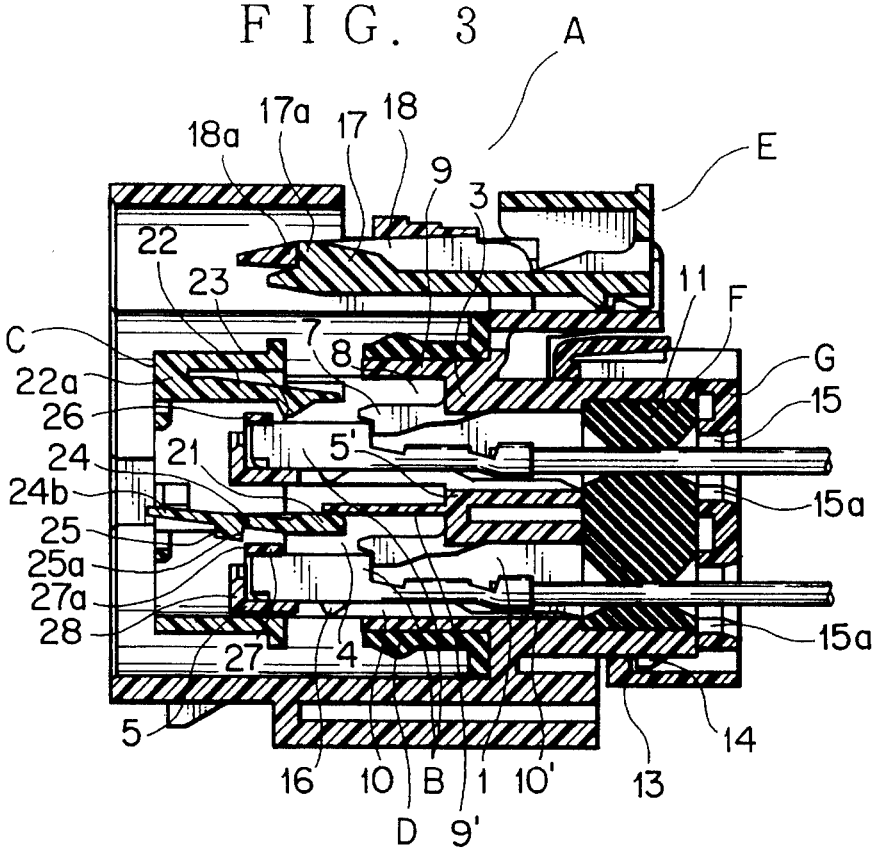
FIG. 3 is a sectional view in a state where terminal metal fittings have been inserted in the state of FIG. 2.

In the state where the front member C is provisionally locked in FIG. 2, as shown in FIG. 3, the terminal metal fittings B are inserted into each of the terminal containers 1 from the rear portion of the connector housing A in such a manner that the resilient locking pieces 7 are shifted into the space 8. When their front ends are hit against a stopper 28, they are locked by the restored locking pieces 7.

In inserting the terminal metal fittings B, the convex portion 16 of the metal fittings B for defining their insertion posture are passed through the through-holes 15 in a state where it is engaged with the concave portion 15*a* for insertion posture definition of the through-hole of the water-proof stopper cover G. Thus, the insertion of the metal fittings B into the terminal containers 1 can be assured with an appropriate posture of the terminal metal fittings B. Thereafter, when the convex portion 16 is engaged with a guide slit 10 from the guide groove 10', the posture of the terminal metal fittings B in the terminal container 1 is stabilized (FIG. 3). Upon completion of the insertion of the terminal metal fittings B, using the handling portion 24*b*, the real locking resilient arm 24 is driven upwards against its resiliency so as to cancel the engagement of the real locking protrusion 25 and the real locking portion 27 (FIG. 3).

Figure 4:
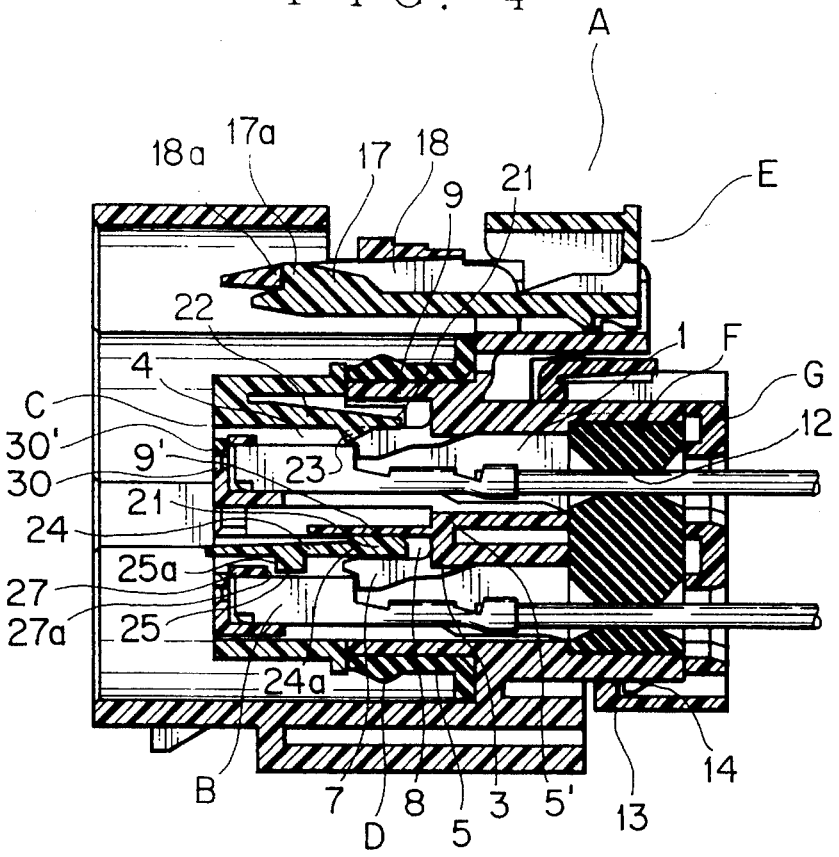
FIG. 4 is a sectional view in a state where a front member for terminal fixing has been really locked with a connector housing.

In this state, the front member C is intruded into the connector housing A so that the real locking protrusion 25 is engaged with the vertical engagement surface 27*a* of the real locking portion 27, thereby assuring the real locking state of the front member C. Then, the above restriction piece 21 intrudes into the opposite space 8 so that the resilient locking piece of the terminal metal fittings B is prevented from being shifted thereby to assure the locking of the terminal metal fittings B (FIG. 4).

Figure 5:
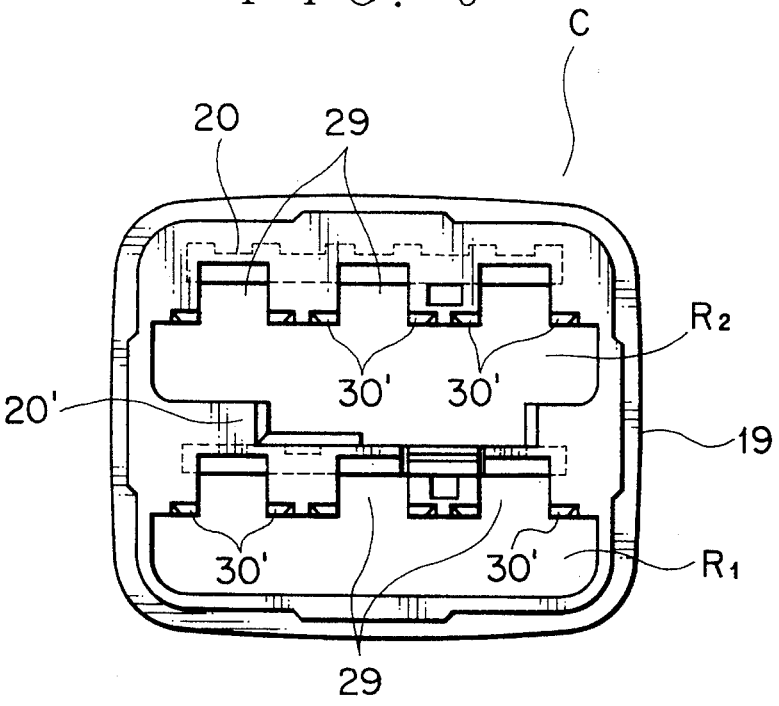
FIG. 5 is a front view of the front member for terminal fixing.

As shown in FIG. 5, at the supporting plate portions 20 and 20' of the front member C for terminal fixing, three jig-insertion recesses 29 are successively provided in the through-hole portions R1 and R2, respectively. Two tapered guide surfaces 30' are formed on both edges of each jig-insertion recess (twelve in total).

Figure 8:
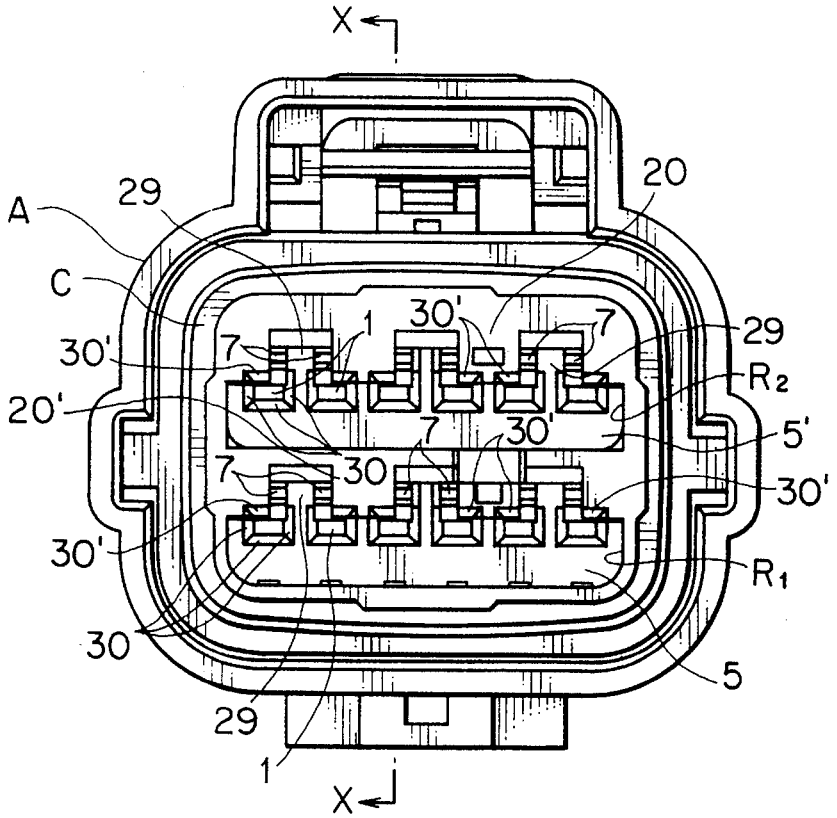
FIG. 8 is a front view of the connector housing in a state where the front member for terminal fixing has been provisionally locked.

FIG. 8 is a front view of the connector housing A in the state where the front member C is provisionally locked. In the jig insertion recess 29, respective halves of the resilient locking pieces 7 and 7 at the upper parts of two adjacent terminal containers 1 and 1 appear. On the other hand, in the through-hole portions R1 and R2, the most portion of the peripheral portion of each terminal container 1 appears except its upper one side. Each of the tapered guide surfaces 30' overlaps the above one side of the upper peripheral portion.

In the periphery of the front opening of the terminal container 1 in the connector housing A, tapered guide surfaces 30 at its lower and left and right sides are formed except the upper portion where the resilient locking piece 7 is located. When the tapered surface 30' is combined with the upper portion of the terminal container 1, the tapered guide surfaces 30 and 30' are located in the entire periphery of the opening of the terminal container 1. Thus, the male metal fittings (not shown) of a partner connector housing is guided so as to be smoothly fit in the female terminal metal fittings B.

Figure 9:
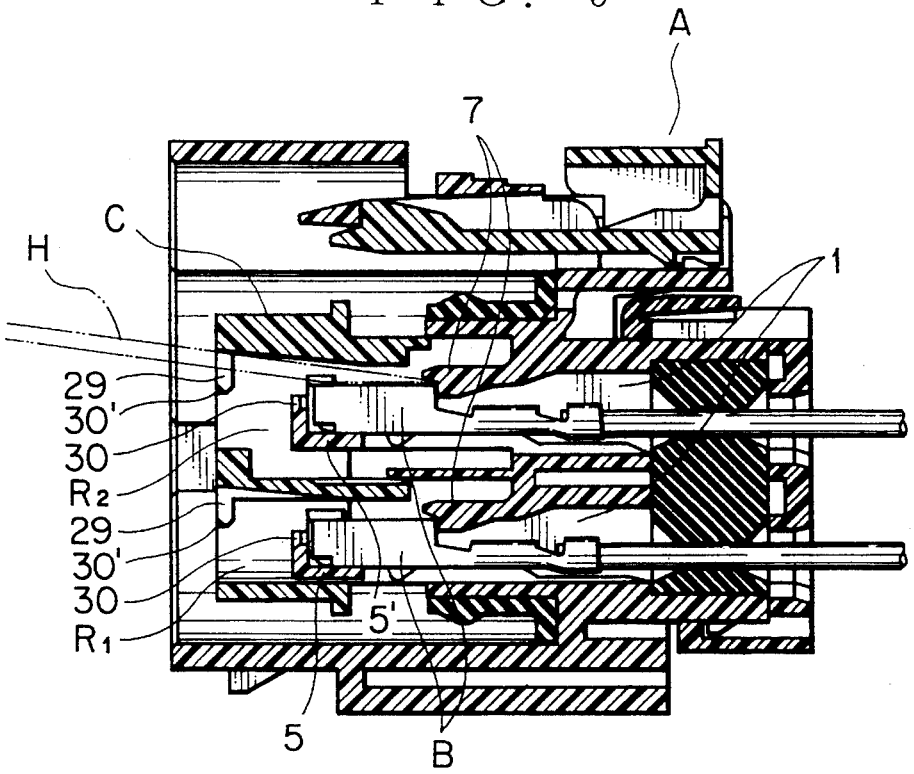
FIG. 9 is a sectional view taken along line X—X in FIG. 8.
Figure 10A:
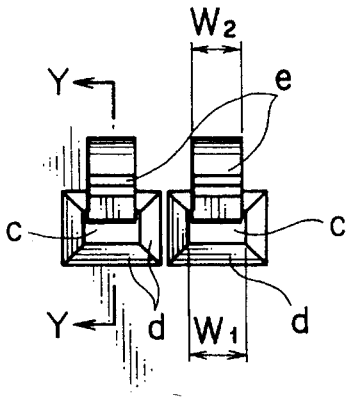
FIG. 10A PRIOR ART
FIG. 10A is a cross sectional view of the terminal container in the prior art.
Figure 10B:
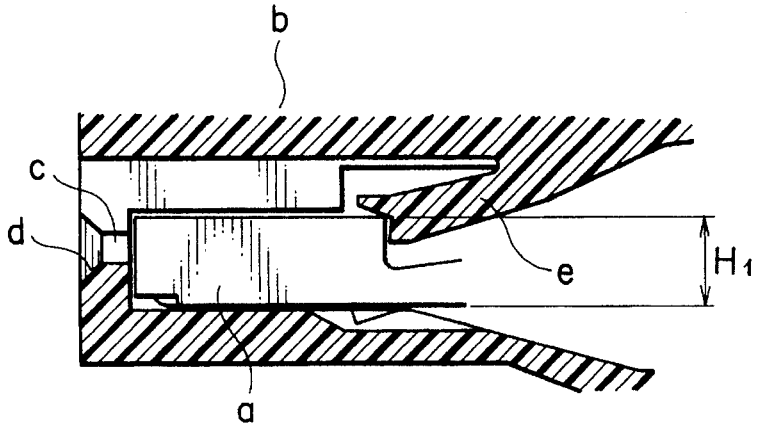
FIG. 10B PRIOR ART
FIG. 10B is a longitudinal cross sectional view taken along line Y— Y in FIG. 10A.
Figure 11A:
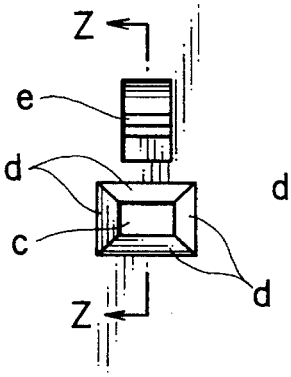
FIG. 11A PRIOR ART
FIG. 11A is a cross sectional view of the terminal in another prior art.
Figure 11B:
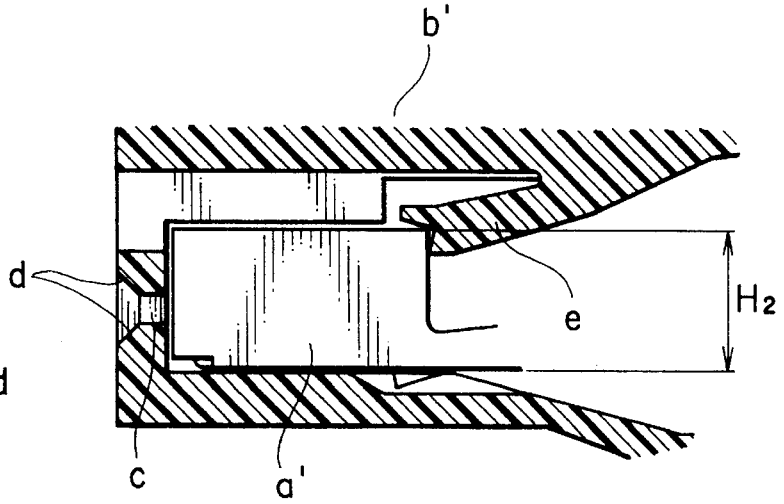
FIG. 11B PRIOR ART
FIG. 11B is a longitudinal sectional view taken along line Z—Z in FIG. 11A.

When a terminal metal fittings B is to be detached, the jig H is inserted into the terminal container 1 from the jig insertion recess 29 and the adjacent two resilient locking pieces 7 and 7 are driven to be disengaged from the terminal metal fittings B and B. Thus, the desired terminal metal fittings B is drawn out (FIG. 9).

We claim:

1. A connector comprising a front member and a connector housing, said connector housing having a plurality of terminal containers for accommodating female terminal metal fittings, and comprising an upper wall defining a portion of each of the plurality of terminal containers, each of the plurality of terminal containers being arranged in parallel with each other within said connector housing, each terminal container having a front opening facing said front member, wherein each front opening has a periphery including a first side thereof, and resilient locking pieces provided on the upper wall for reversibly locking the female terminal fittings to the connector, each of the resilient locking pieces being arranged in parallel with each other, said front member coupled with said connector housing and defining a through-hole portion and jig-insertion recesses, the jig-insertion recesses being in communication with the through-hole portion, tapered guide surfaces provided on opposite sides of and adjacent to each jig-insertion recess, wherein each tapered guide surface at least partially overlaps the first side of the periphery of each front opening of each of the plurality of terminal containers.

2. A connector according to claim 1, wherein said front member is coupled with said connector housing at a provisional locking position and a real locking position.

3. A connector according to claim 1, wherein the periphery of each front opening of each of the plurality of terminal containers further includes a second side, a third side and a fourth side, tapered guide surfaces provided on each of said second side, third side and fourth side.

4. A connector according to claim 1, further comprising a jig means for unlocking the female terminal fittings from the connector by releasing the female terminal fittings from said resilient locking pieces, by insertion of said jig means into the terminal container through one of the jig-insertion recesses.

5. A method for unlocking female terminal fittings from a connector, said method comprising providing a connector comprising a front member and a connector housing, said connector housing having a plurality of terminal containers for accommodating the female terminal metal fittings, and comprising an upper wall defining a portion of each of the plurality of terminal containers, each of the plurality of terminal containers being arranged in parallel with each other within said connector housing, each terminal container having a front opening facing said front member, wherein each front opening has a periphery including a first side thereof, and resilient locking pieces provided on the upper wall for reversibly locking the female terminal fittings to the connector, each of the resilient locking pieces being arranged in parallel with each other, said front member coupled with said connector housing and defining a through-hole portion and jig-insertion recesses, the jig-insertion recesses being in communication with the through-hole portion, tapered guide surfaces provided on opposite sides of and adjacent to each jig-insertion recess, wherein each tapered guide surface at least partially overlaps the first side of the periphery of each front opening of each of the plurality of terminal containers;

disengaging one of said resilient locking pieces from one of the female terminal fittings reversibly locked thereto by inserting a jig into one of the plurality of terminal containers through one of the jig-insertion recesses, to produce a disengaged female terminal fitting; and removing the disengaged female terminal fitting from the connector.

* * * * *

UNITED STATES PATENT AND TRADEMARK OFFICE

CERTIFICATE OF CORRECTION

PATENT NO. : 5,529,515

DATED : June 25, 1996

INVENTOR(S) : Ohtaka et al.

It is certified that error appears in the above-indentified patent and that said Letters Patent is hereby corrected as shown below:

On the title page, insert item [56]:

The Foreign Priority has been omitted, please insert therefor number -- 5-196183 -- country -- JAPAN -- and date -- August 6, 1993 --.

Signed and Sealed this

Third Day of December, 1996

*Attest:*

*Attesting Officer*

BRUCE LEHMAN

*Commissioner of Patents and Trademarks*